US010520274B2

(12) United States Patent
Bartels

(10) Patent No.: US 10,520,274 B2
(45) Date of Patent: Dec. 31, 2019

(54) CROSSBOW ASSEMBLY

(71) Applicant: Hunter's Manufacturing Company, Inc., Suffield, OH (US)

(72) Inventor: Keith Bartels, Suffield, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 16/387,974

(22) Filed: Apr. 18, 2019

(65) Prior Publication Data

US 2019/0242671 A1 Aug. 8, 2019

Related U.S. Application Data

(63) Continuation of application No. 15/906,115, filed on Feb. 27, 2018, now Pat. No. 10,267,592.

(60) Provisional application No. 62/528,648, filed on Jul. 5, 2017.

(51) Int. Cl.
*F41B 5/12* (2006.01)

(52) U.S. Cl.
CPC ..... *F41B 5/123* (2013.01)

(58) Field of Classification Search
CPC .... F41B 5/12; F41B 5/123; F41B 5/14; F41B 5/1403
USPC ..... 124/25
See application file for complete search history.

(56) References Cited

U.S. PATENT DOCUMENTS 2,092,361 A 9/1937 Shim
3,043,287 A 7/1962 Nelson
3,515,113 A * 6/1970 Lawrence ..... F41B 5/12 124/27
3,561,419 A 2/1971 Cucuzza, Sr.
3,670,711 A 6/1972 Firestone
3,739,765 A 6/1973 Moore
4,169,456 A * 10/1979 Van House ..... F41B 5/12 124/25
4,192,281 A 3/1980 King
4,246,883 A 1/1981 Ash
(Continued)

OTHER PUBLICATIONS

A Guide to the Crossbow, by W.F. Paterson, published by the Society of Archer-Antiquaries, 1990.

(Continued)

*Primary Examiner* — Alexander R Niconovich

(74) *Attorney, Agent, or Firm* — Emerson Thomson Bennett, LLC

(57) ABSTRACT

Provided is a bow assembly comprising a main beam elongated in a first direction to define a distal end, and a proximal end, wherein the distal end has a distal end facing surface from which extend, an upper member, and a lower member having a first set of threads thereon; and a riser having a proximate facing surface, an upper groove dimensioned to engage the upper member, and a lower opening through hole dimensioned to engage the lower member; a threaded fastener adapted to threadedly engaged the first set of threads; and wherein the riser is assembled with the main beam and the threaded fastener such that the upper member is inserted within the upper groove, the lower member is inserted within the lower opening, the distal end facing surface faces the proximate facing surface, and the threaded fastener is threadedly engaged with the first set of threads.

1 Claim, 17 Drawing Sheets

(56) References Cited

U.S. PATENT DOCUMENTS 4,457,287 A * 7/1984 Babington ..... F41B 5/10 124/23.1
4,593,675 A 6/1986 Waiser
4,603,676 A 8/1986 Luoma
4,649,891 A * 3/1987 Bozek ..... F41B 5/123 124/25
4,649,892 A 3/1987 Bozek
4,662,345 A 5/1987 Stephens
4,665,885 A 5/1987 Glomski et al.
4,719,897 A 1/1988 Gaudreau
4,721,092 A 1/1988 Waiser
4,722,317 A * 2/1988 Hartwig ..... F41B 5/10 124/25.6
4,766,874 A * 8/1988 Nishioka ..... F41B 5/12 124/25
4,879,987 A * 11/1989 Nishioka ..... F41B 5/123 124/25
4,917,071 A * 4/1990 Bozek ..... F41B 5/12 124/24.1
4,942,861 A 7/1990 Bozek
5,115,795 A 5/1992 Farris
5,205,267 A 4/1993 Burdick
5,215,069 A 6/1993 Liu
5,220,906 A 6/1993 Choma
5,243,956 A 9/1993 Luehring
5,433,186 A 7/1995 Corwin
5,437,260 A 8/1995 King
5,445,139 A 8/1995 Bybee
5,553,596 A 9/1996 Bednar
5,598,829 A 2/1997 Bednar
5,649,520 A 7/1997 Bednar
5,678,528 A * 10/1997 Hadley ..... F41B 5/12 124/24.1
5,853,001 A 12/1998 Vyprachticky
5,987,724 A 11/1999 Kleman
6,095,128 A 8/2000 Bednar
6,286,496 B1 9/2001 Bednar
6,776,148 B1 * 8/2004 Islas ..... F41B 5/10 124/25.6
6,792,931 B1 * 9/2004 Schaar ..... F41B 5/10 124/25.6
6,874,491 B2 4/2005 Bednar
6,913,007 B2 7/2005 Bednar
7,047,958 B1 * 5/2006 Colley ..... F41B 5/10 124/25.6
7,100,590 B2 9/2006 Chang
7,178,514 B2 2/2007 Chang
7,578,289 B2 * 8/2009 Norkus ..... F41B 5/0094 124/25
7,624,725 B1 12/2009 Choma
7,784,453 B1 8/2010 Yehle
7,823,572 B2 * 11/2010 Anderson ..... F41B 5/123 124/25
7,891,348 B2 * 2/2011 Colley ..... F41B 5/123 124/25
8,225,777 B2 * 7/2012 Chu ..... F41B 5/123 124/25
8,387,603 B2 * 3/2013 Darlington ..... F41B 5/10 124/23.1
8,387,604 B1 * 3/2013 Terzo ..... F41B 5/123 124/23.1
8,443,790 B2 5/2013 Pestrue
8,485,170 B1 * 7/2013 Prior ..... F41B 5/123 124/25
8,499,753 B2 8/2013 Bednar
8,522,762 B2 * 9/2013 Trpkovski ..... F41B 5/0094 124/25.6
8,651,095 B2 * 2/2014 Islas ..... F41B 5/105 124/25
9,121,659 B1 * 9/2015 Chang ..... F41B 5/123
9,234,719 B1 * 1/2016 Kempf ..... F41B 5/105
9,243,861 B1 * 1/2016 Kempf ..... F41B 5/12
9,255,756 B1 * 2/2016 Wu ..... F41B 5/123
9,297,604 B1 * 3/2016 Sidebottom ..... F41B 5/123
9,377,267 B1 * 6/2016 Kempf ..... F41B 5/105
9,513,080 B1 * 12/2016 Kempf ..... F41B 5/123
9,879,938 B1 * 1/2018 Isenhower ..... F41B 5/123
10,018,442 B1 * 7/2018 Kempf ..... F41B 5/123
10,190,841 B2 * 1/2019 Laurence ..... F41B 5/123
10,209,026 B2 * 2/2019 Yehle ..... F41B 5/066
10,254,072 B2 * 4/2019 Danielsson ..... F41B 5/10
2006/0086346 A1 4/2006 Middleton
2010/0170488 A1 1/2010 Rasor et al.
2011/0056467 A1 * 3/2011 Popov ..... F41B 5/0094 124/25.6

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

CROSSBOW ASSEMBLY

CROSS-REFERENCE TO RELATED APPLICATIONS

This application is a continuation of application Ser. No. 15/906,115, filed Feb. 27, 2018, which claims the benefit of U.S. Provisional Application No. 62/528,648, filed Jul. 5, 2017, the entirety of each of which are fully incorporated by reference herein.

BACKGROUND

The present subject matter generally relates to apparatus and methods related to crossbows.

Crossbows may be used as a weapon for hunting and fishing, and for target shooting. In general, a crossbow includes a main beam including a stock member and a barrel connected to the stock member. The barrel typically has an arrow receiving area for receiving the arrow that is to be fired or shot. The crossbow also may include a bow assembly supported on the main beam that includes a bow (including a pair of bow limbs) and a bowstring connected to the bow for use in shooting arrows. The bow assembly may be supported to the main beam via a riser or block. A trigger mechanism may also be supported on the main beam and may hold the bowstring in a drawn or cocked condition. The trigger mechanism may thereafter be operated to release the bowstring to an uncocked condition to fire or shoot the arrow.

To attach crossbow risers to main beams, it is known to use screws, bolts, pins or the like that are inserted into aligned openings formed in both the main beam and the riser. While such connections generally work well for their intended purposes, they are time-consuming, require one or more relatively small connectors that can be easily lost, and are often not as strong as would be preferred. These problems can be significantly reduced according to some aspects of the present teaching.

To attach bow limbs to bow risers, it is known to use wedges or spacer blocks between the bow limb and riser. Such known devices, however, are complicated and difficult to properly align. These problems can be significantly reduced according to some aspects of the present teaching.

To reduce vibrations, it is known to provide crossbows with vibration dampeners that are contacted by the bowstring after the crossbow has been fired. While many known vibration dampeners work well for their intended purposes, they are complicated and extend relatively long distances from the riser; adding unwanted weight, cost and interference. These problems can be significantly reduced according to some aspects of the present teaching.

It is known to provide a power cable (distinguished from a bowstring) that extends from one compound bow cam/wheel to a power cable support wheel mounted to the riser; without the power cable extending to the opposite cam/wheel. Known power cable support wheels, however, are complicated and are positioned relatively long distances from the riser; adding unwanted weight, cost and interference. Inventors of the present subject matter have also discovered that the orientation of known power cable support wheels can be improved.

SUMMARY

Provided is a bow assembly comprising a main beam elongated in a first direction to define a distal end, and a proximal end, wherein the distal end has a distal end facing surface from which extend, an upper member, and a lower member having a first set of threads thereon; and a riser having a proximate facing surface, an upper groove dimensioned to engage the upper member, and a lower opening through hole dimensioned to engage the lower member; a threaded fastener adapted to threadedly engaged the first set of threads; and wherein the riser is assembled with the main beam and the threaded fastener such that the upper member is inserted within the upper groove, the lower member is inserted within the lower opening, the distal end facing surface faces the proximate facing surface, and the threaded fastener is threadedly engaged with the first set of threads.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DEFINITIONS

The following definitions are controlling for the disclosed inventions:

"Arrow" means a projectile that is shot with (or fired by or launched by) a bow assembly.

"Bow" means a bent, curved, or arched object. A bow includes a pair of bow limbs.

"Bow Assembly" means a weapon comprising a bow and a bowstring that shoots (or fires or propels) arrows powered by the elasticity of the bow and the drawn bowstring.

"Bowstring" means a string or cable attached to a bow that contacts an arrow (or an intermediary object such as a nock) to shoot (or fire or propel) the arrow.

"Compound Bow" means a bow that has wheels, pulleys or cams at each end of the bow through which the bowstring passes. A compound bow may include power cables, in addition to the bowstring, that interconnect the wheels, pulleys or cams to each other and/or to other portions of the bow.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. A main beam may include a stock member and a barrel. Sometimes a barrel is a distinct component from the stock member that is attached to the stock member. Other times the barrel and stock member comprise a single component.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Figure 1:
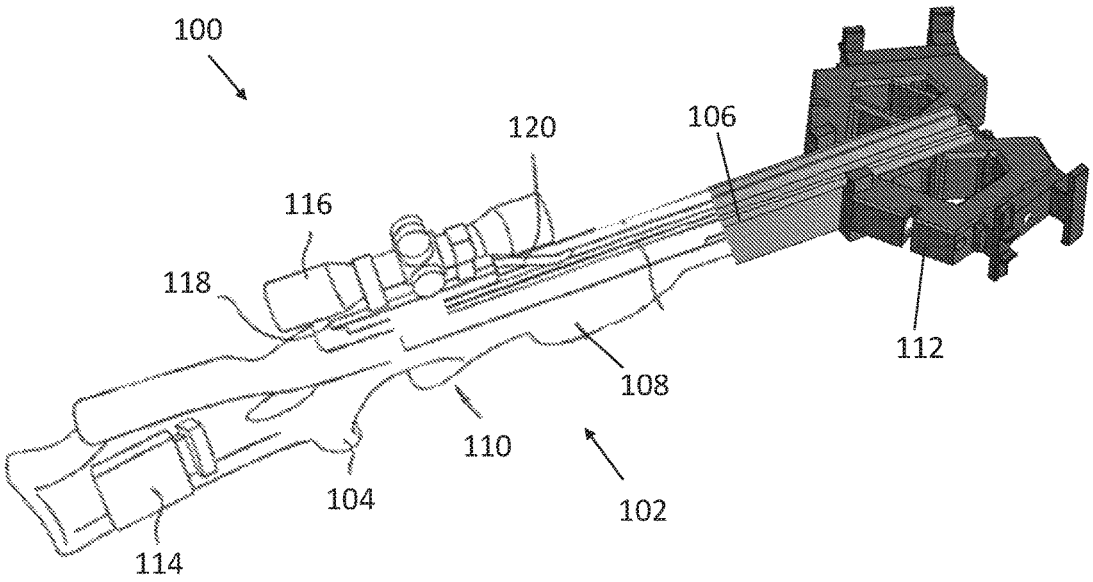
FIG. 1 is a perspective top view of a crossbow with the bow assembly removed.

Referring now to the drawings wherein the showings are for purposes of illustrating embodiments of the present subject matter only and not for purposes of limiting the same, and wherein like reference numerals are understood to refer to like components, FIG. 1 shows some aspects of the present subject matter with a crossbow 100 that may include a main beam 102 including a stock member 104 and a barrel 106. An optional handgrip 108 may be mounted to the main beam 102 in any conventional manner. A trigger mechanism 110 suitable for releasing/shooting an arrow may be mounted to the main beam 102 in any suitable manner. It should be noted that the crossbow 100 may comprise any trigger mechanism 110 chosen with the sound judgment of a person of skill in the art. The crossbow 100 may include a riser or block 112 which will be discussed further below. An optional cocking unit 114 may be provided for use in cocking the crossbow 100. Other optional components may include a scope 116 attached to a scope mount 118 that is supported on the main beam 102. Another optional component shown is an arrow retention spring 120. As the operation of these components is well known to those of skill in the art, no further details will be provided.

Figure 2:
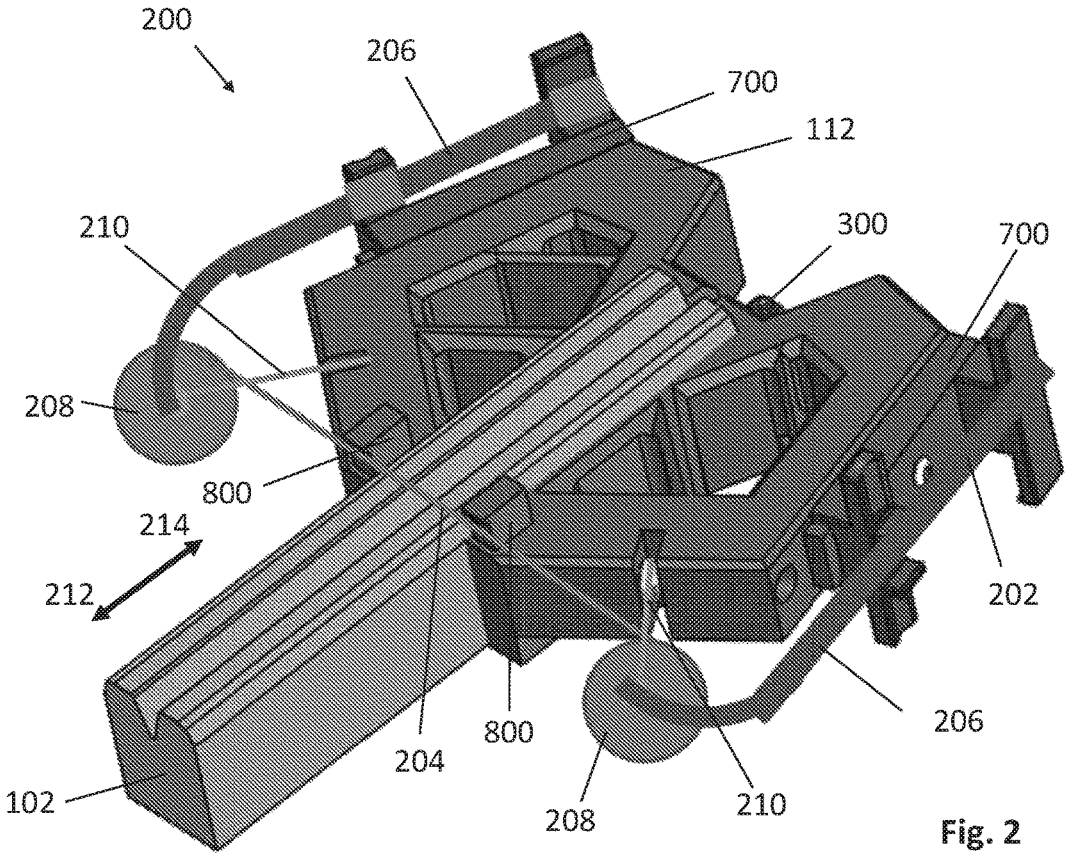
FIG. 2 is a perspective top view of the distal end of the crossbow shown in FIG. 1 but with a bow assembly shown in schematic representation.

FIG. 2 shows the distal end of the crossbow shown in FIG. 1 but with a bow assembly 200, shown in schematic representation, attached to the riser 112. As used herein, the distal end is the end of the crossbow with the bow assembly engaged therewith and is opposite the proximal end, which is the end of the crossbow closer to the stock member 104. The bow assembly 200 may be adapted to propel an arrow and may comprise a bow 202 and a bowstring 204. The bow 202 may include a pair of bow limbs 206, 206 that receive the bowstring 204 in any conventional manner chosen with the sound judgment of a person of skill in the art. A pair of cams (which may be also pulleys and/or wheels) 208, 208 may be mounted to the bow limbs 206, 206 and receive the bowstring 204 in a known manner; making the bow assembly 200 a compound bow. However, it should be understood that aspects of the present teaching of this subject matter will work well with any type of bow chosen with sound judgment of a person of skill in the art. A pair of power cables 210, 210 may be interconnected between the cams 208, 208 and the crossbow as will be discussed further below. The bowstring 204 may be moved in direction 212 to draw or cock the crossbow and may be thrust in opposite direction 214 to fire or shoot an arrow, as is well known to persons of skill in the art.

Figure 3:
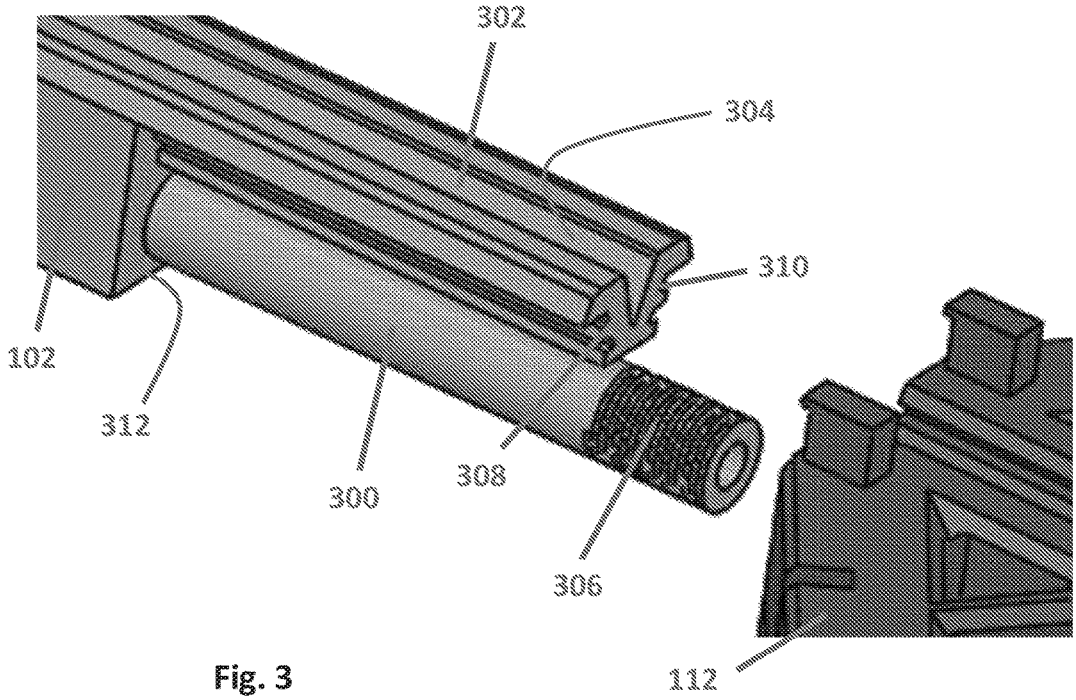
FIG. 3 is a side perspective view of the distal end of a crossbow main beam.
Figure 5:
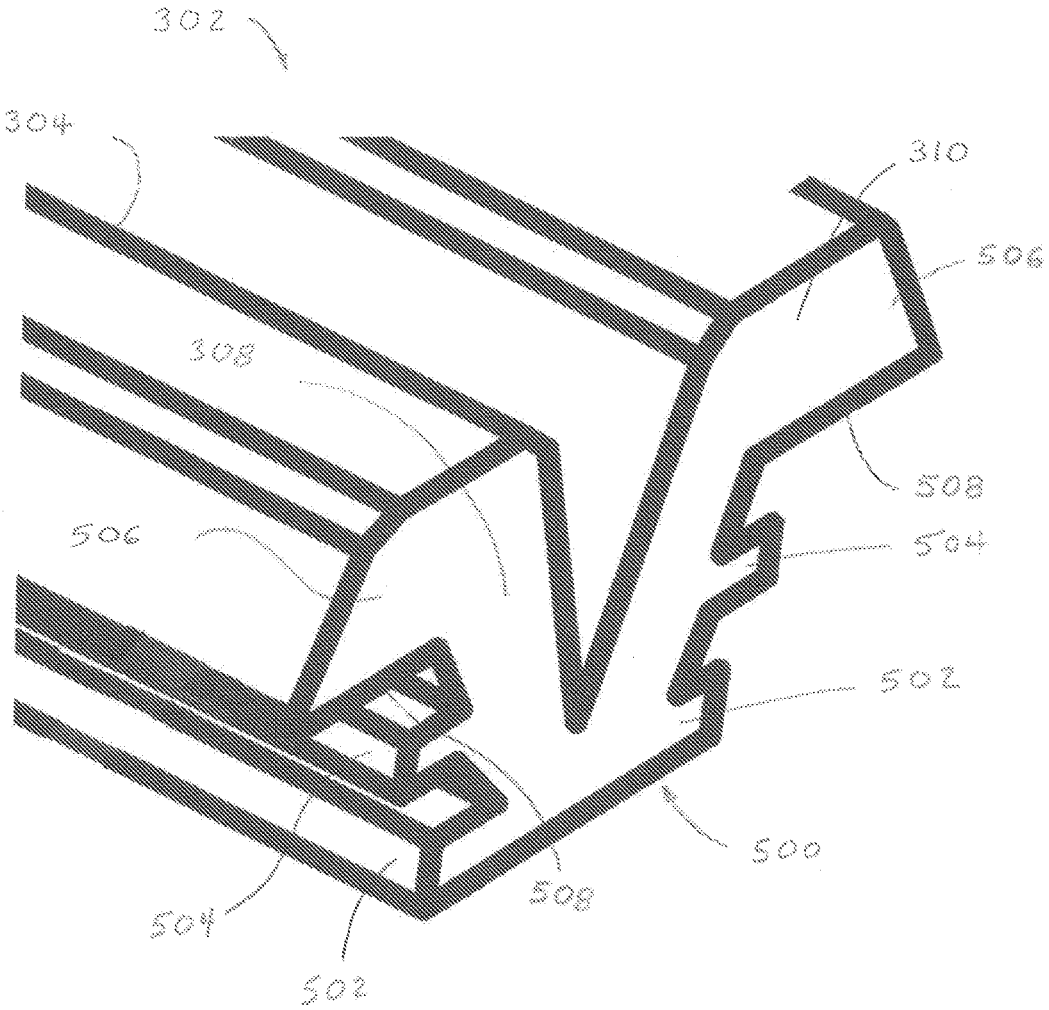
FIG. 5 is a close-up perspective view of the distal end of the upper member of the crossbow main beam shown in FIG. 3.

With reference now to FIG. 3, according to some aspects of the present teaching, the distal end of the main beam 102 may have a lower member 300 and an upper member 302, both extending generally longitudinally, as shown. The lower and upper members 300, 302 may be separated, as shown. The upper member 302 may include an arrow receiving slot 304 on its upper surface and may have a generally V-shaped cross-section, as shown. The lower member 300 may extend longitudinally from a generally distally facing surface 312 and may have a generally cylindrical shape, as shown. It should be understood that the cross-sections shown of the lower and upper members 300, 302 in the FIGURES are non-limiting and that there are many other equally acceptable forms that are contemplated. The distal end of the lower member 300 may have a threaded region 306 on its outer surface. Referring now also to FIG. 5, the upper member 302 may have a lower surface 500 and first and second walls 308, 310, extending upward and outward. Each wall 308, 310 may have one or more laterally extending arms. According to some aspects of the present teaching, each wall may have a lower laterally extending arm 502, a mid-portion laterally extending arm 504 and an upper laterally extending arm 506. The amount of lateral arm extension may increase, as shown, moving upward. Each upper arm 506 may have a lower surface 508.

Figure 4:
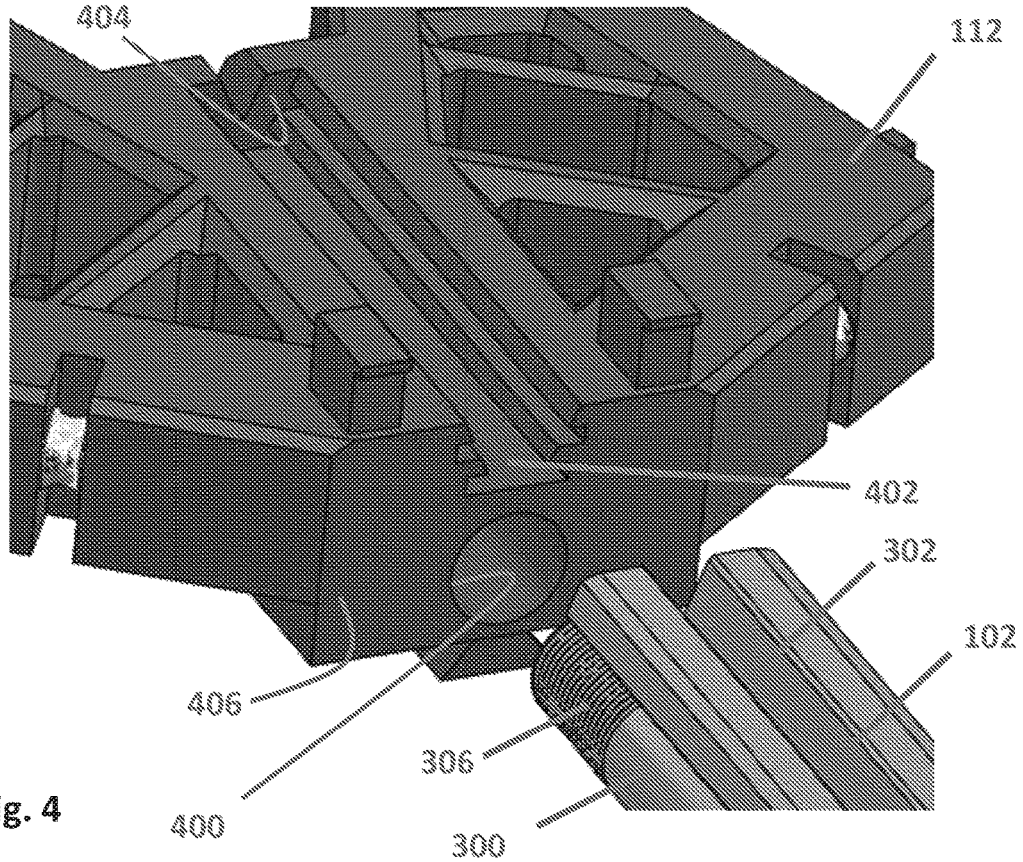
FIG. 4 is a top perspective view of a crossbow riser.
Figure 6:
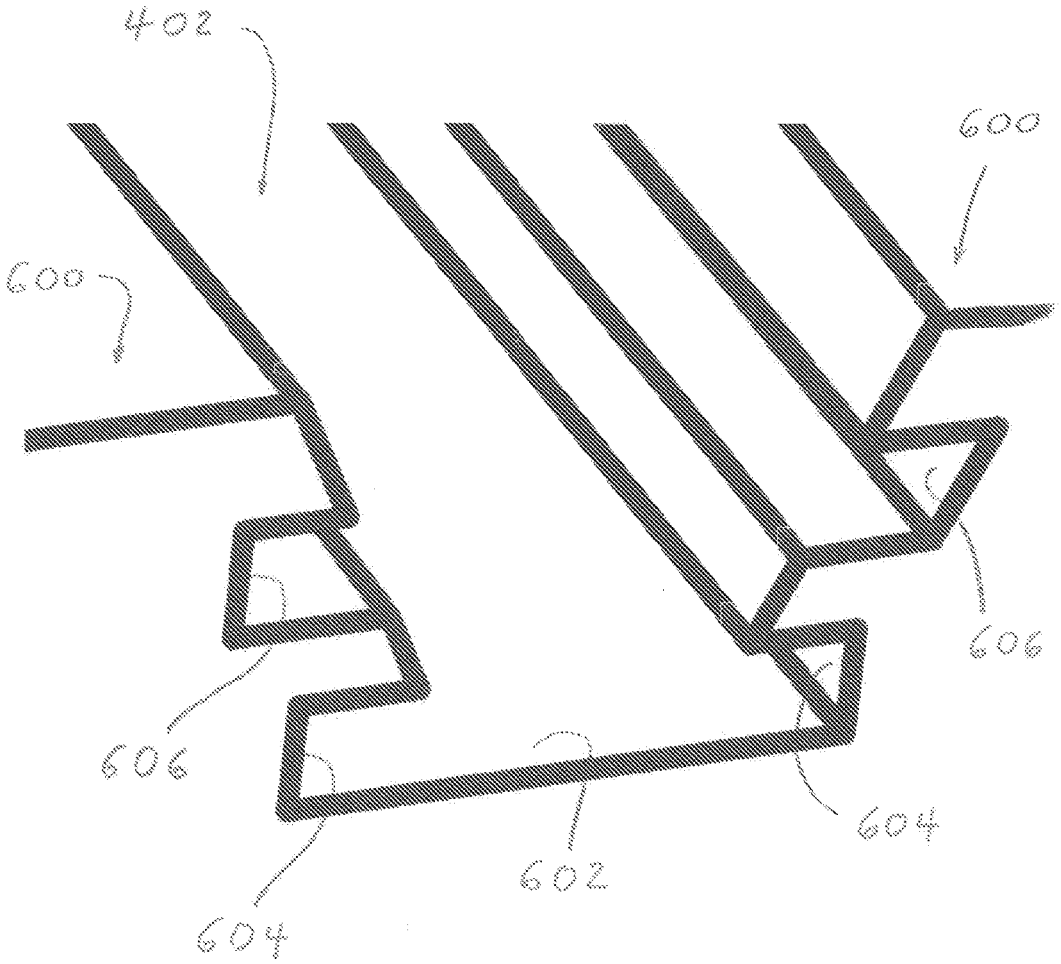
FIG. 6 is a close-up perspective view of the proximal end of the upper groove of the crossbow riser shown in FIG. 4.

With reference now to FIG. 3-4, the riser 112 may comprise a lower opening 400 and an upper groove 402. The opening 400 may be of a shape to match the lower member 300 and the groove 402 may be of a shape to match the upper member 302. The opening 400 may be cylindrical in shape to match the lower member 300 and the groove 402 may be generally V-shaped to match the upper member 302. Lower opening 400 may be dimensioned to engage the lower member 300 in a close sliding fit. In certain nonlimiting embodiment a close sliding fit may provide for accurate location of parts which must assemble without noticeable play. A close sliding fit may be complaint with good engineering judgment and may be substantially or entirely compliant with RC1 fit per ANSI B 4.1 and may, without limitation, be on the order or 0.0004 inches per inch. Upper groove 402 may be dimensioned to engage the upper member 302 in a close sliding fit. The riser 112 may have a generally proximally facing surface 406 and a wall 404 that is positioned at the distal end of the groove and that generally faces proximally. Some embodiments may omit the wall 404. Referring now also to FIGS. 5-6, the riser may have an outer surface 600 into which groove 402 is formed. Groove 402 may be defined by a surface including a lower surface 602. The groove 402 may have one or more laterally extending slots. According to some aspects of the present teaching, lower laterally extending slots 604, 604 are positioned and sized to receive lower laterally extending arms 502, 502 and mid-portion laterally extending slots 606, 606 are positioned and sized to receive mid-portion laterally extending arms 504, 504.

With reference now to FIGS. 3-6, a tight yet easy to achieve interconnection may be established between the main beam 102 and the riser 112. To connect the main beam 102 to the riser 112, the distal end of the lower member 300 may be inserted into and moved relative to the riser 112 within opening 400 while the distal end of the upper member 302 is inserted into and moved relative to the riser 112 within groove 402. During this motion, main beam surface 500 may slide on riser surface 602, main beam arms 502, 502 may slide within riser slots 604, 604, main beam arms 504, 504 may slide within riser slots 606, 606, and main beam surfaces 508, 508 may slide on riser surfaces 600, 600. Insertion may be complete when the distal end of the main beam upper member 302 comes into contact with riser wall 404, or when main beam surface 312 comes into contact with riser surface 406. At this point, the distal end of the lower member 300 will extend distally out from the riser 112, as shown in FIG. 2. A threaded fastener, such as, without limitation, a nut, can then be threaded onto threaded region 306 to secure the main beam 102 to the riser 112. With this design no separate screws, bolts or pins are required and no openings are required in the main beam 102. The only openings required in the riser 112 are those used to receive portions of the main beam 102. No small connectors are required. The interconnection between the main beam 102 and the riser 112 is precise and strong yet very easy and fast to achieve.

Figure 7:
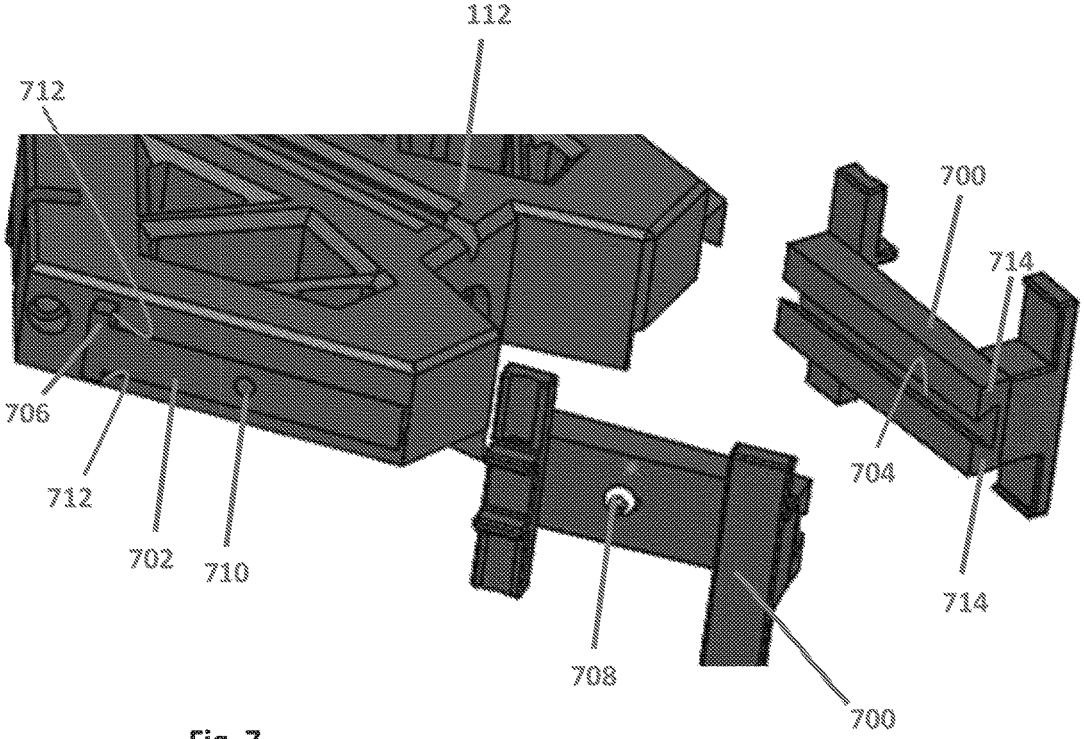
FIG. 7 is a side perspective view of a crossbow riser and limb attachment brackets.

With reference now to FIG. 7, to attach the bow limbs to the riser 112, attachment brackets 700, 700 may be used. Each bracket 700 may have a first side to which the bow limb is attached and a second side which is attached to the riser 112. This can be seen, for example, in FIG. 2. According to some aspects of the present teaching, the attachment of the bracket 700 to the riser 112 may include a tongue and groove interconnection. A tongue 702 may be formed on an outer surface of each side of the riser 112 and a matching groove 704 may be formed on each bracket 700. The tongue and groove interconnection may be a dovetail shape, as shown. To attach a bow limb attachment bracket 700 to the riser 112, the bracket 700 may be slid onto the riser 112 with the tongue 702 being received in the groove 704. At a distal end of the tongue 702, a wall 706 that extends generally opposite the longitudinal axis of the tongue 702 and that serves as a stop properly positioning the bracket 700 with respect to the riser 112 may be positioned. Specifically, the wall 706 may have at least one surface 712 (two shown) that extend beyond the tongue 702 surface, as shown. The bracket 700 may have at least one surface 714 (two shown) positioned outside the groove 704, as shown. The bracket 700 may be slid onto the riser 112 with the tongue 702 received in the groove 704 until the bracket surface(s) 714 contacts wall surface(s) 712. With this contact, which the user can easily feel and likely hear, proper relative position, and thus proper alignment, will be easily achieved. Once the bracket 700 is properly positioned on the riser 112, a bolt 708 may be inserted through a hole in the bracket 700 and into a hole 710 formed in the tongue 702 to secure the bracket 700 to the riser 112.

Figure 8:
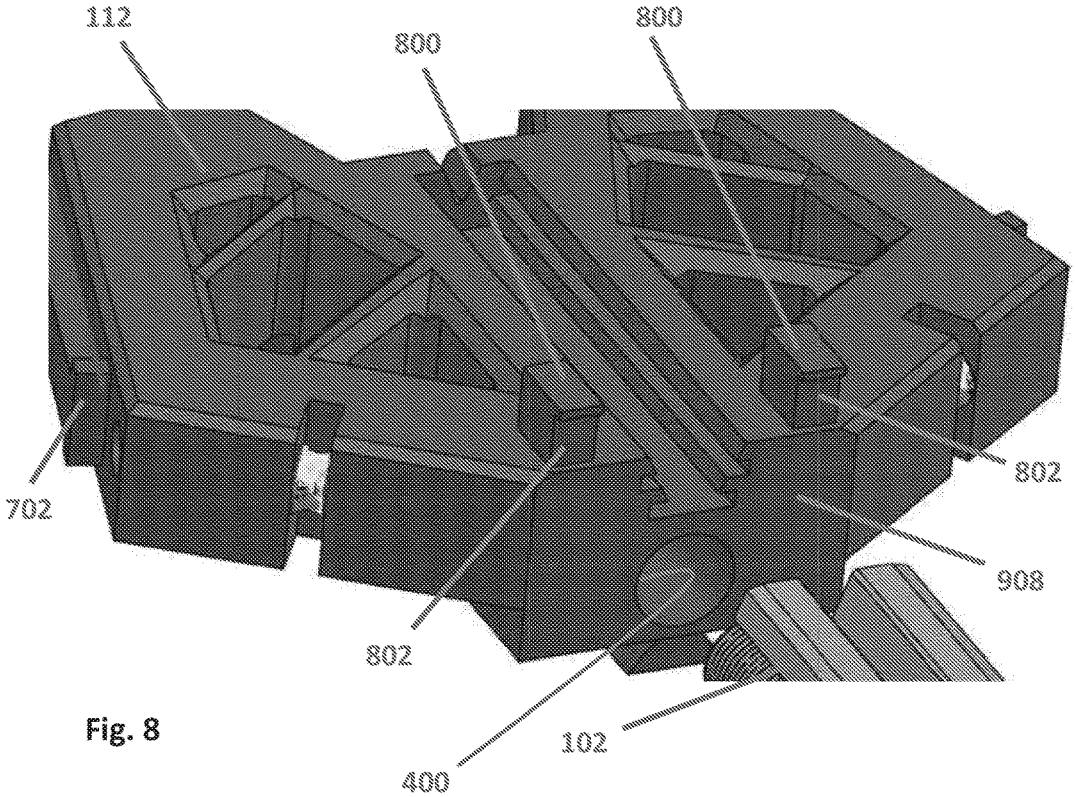
FIG. 8 is a top perspective view of a crossbow riser.
Figure 9:
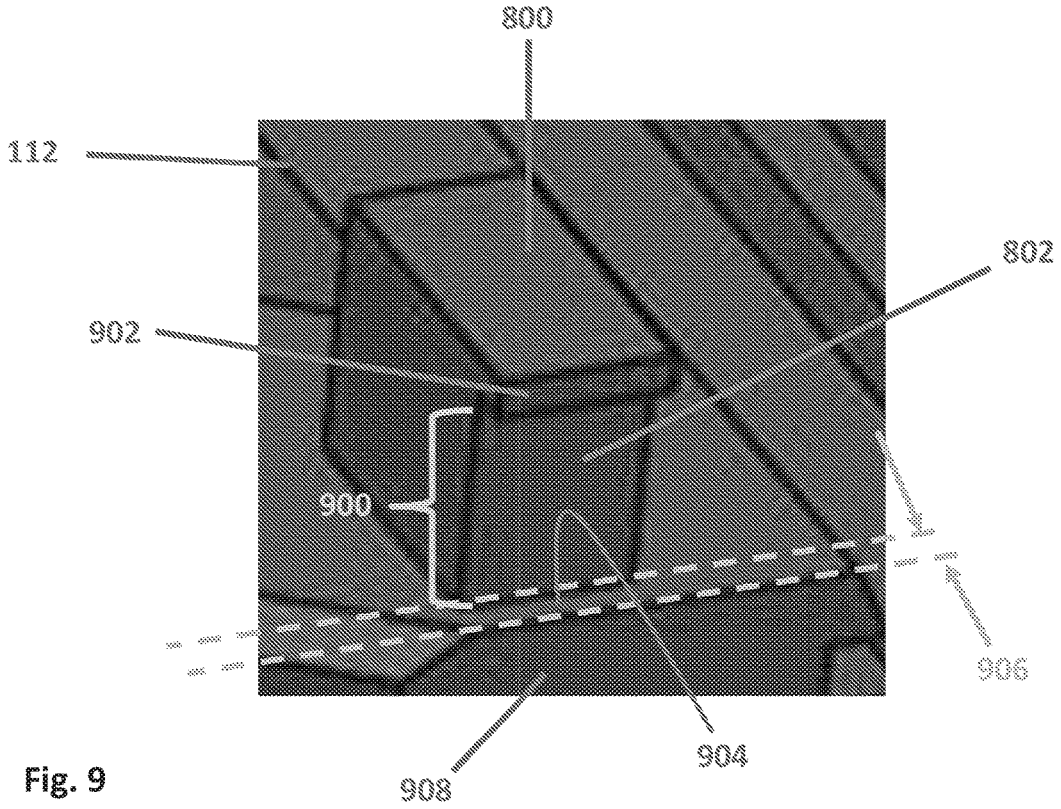
FIG. 9 is a close-up view of a bowstring dampener shown in FIG. 8.
Figure 10:
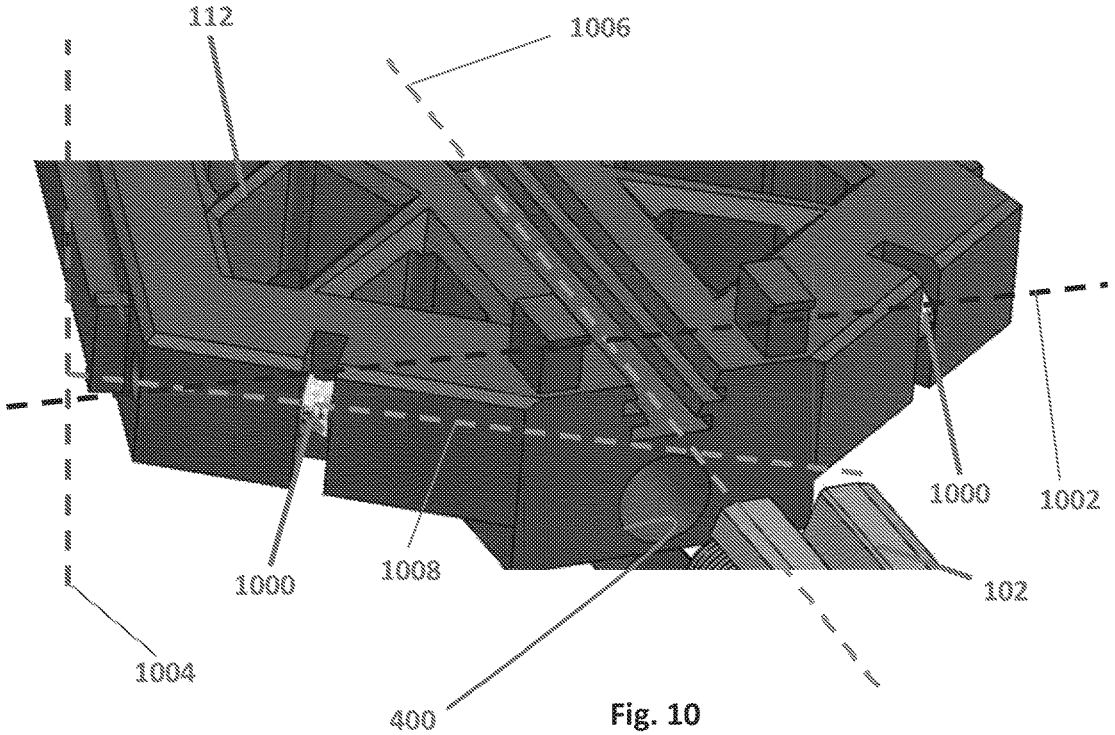
FIG. 10 is a top perspective view of a crossbow riser.

With reference now to FIGS. 8-9, according to some aspects of the present teaching, one or more bowstring dampeners, two shown 800, 800, may be used to dampen vibrations created by firing the crossbow. Specifically, as shown in FIG. 2, the bowstring 204 may contact the dampeners 800, 800 after the bowstring has been released; thereby damping the resultant vibrations. Each dampener 800, with reference again to FIGS. 8-9, may include a contact surface 802 that is made of a vibration dampening material and designed to be contacted by the bowstring. Each dampener 800 may be attached to the riser 112 in any manner chosen with the sound judgment of a person of skill in the art. Non-limiting attachment options include connectors and adhesives. Each dampener 800 may define, along with the riser 112, a channel 900 into which the bowstring is received. According to some aspects of the present teaching, the channel 900 may be defined by contact surface 802, the undersurface of a lip 902 that extends proximally over the contact surface 802, and a surface 904 of the riser 112, as shown. The undersurface of lip 902 and the riser surface 904 may serve as upper and lower limits, respectively, to maintain the bowstring within the channel 900 and to ensure that the bowstring contacts contact surface 802. Riser surface 904 may have a width 906 between the contact surface 802 and a proximally facing surface 908 of the riser 112. Width 906 may be the same as a corresponding width of the undersurface of lip 902. Width 906 may have a dimension that is at least half the cross-sectional diameter of the bowstring. Each bowstring dampener 800 may be attached to an outer and upper surface of the riser 112, as shown. With this design, the bowstring contact surfaces 802, 802 are positioned near the riser 112 reducing weight, cost and interference when compared to previously known bowstring dampeners.

Figure 11:
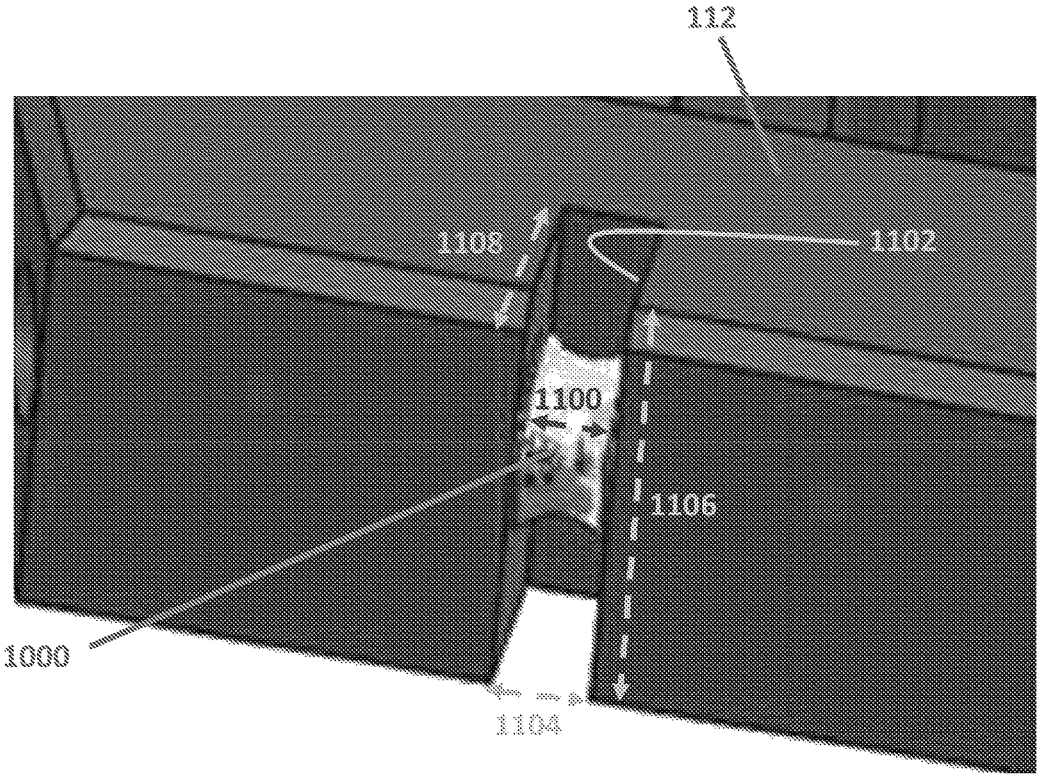
FIG. 11 is a close-up view of a power cable pulley/wheel shown in FIG. 10.
Figure 12:
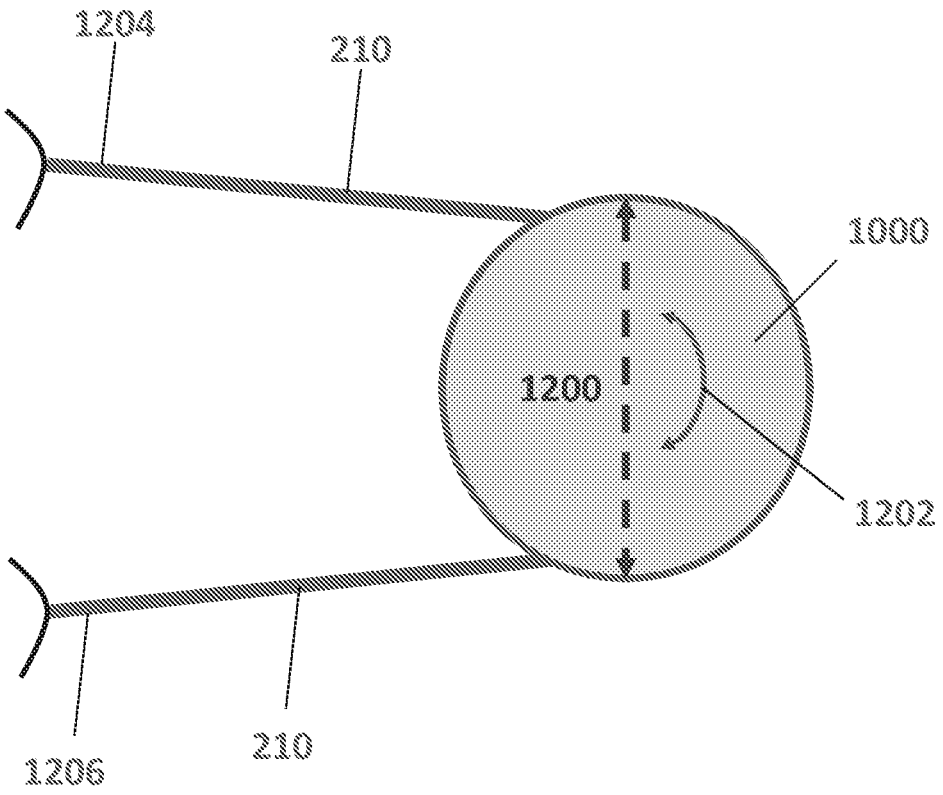
FIG. 12 is a side view of a power cable pulley/wheel in schematic representation.
Figure 13:
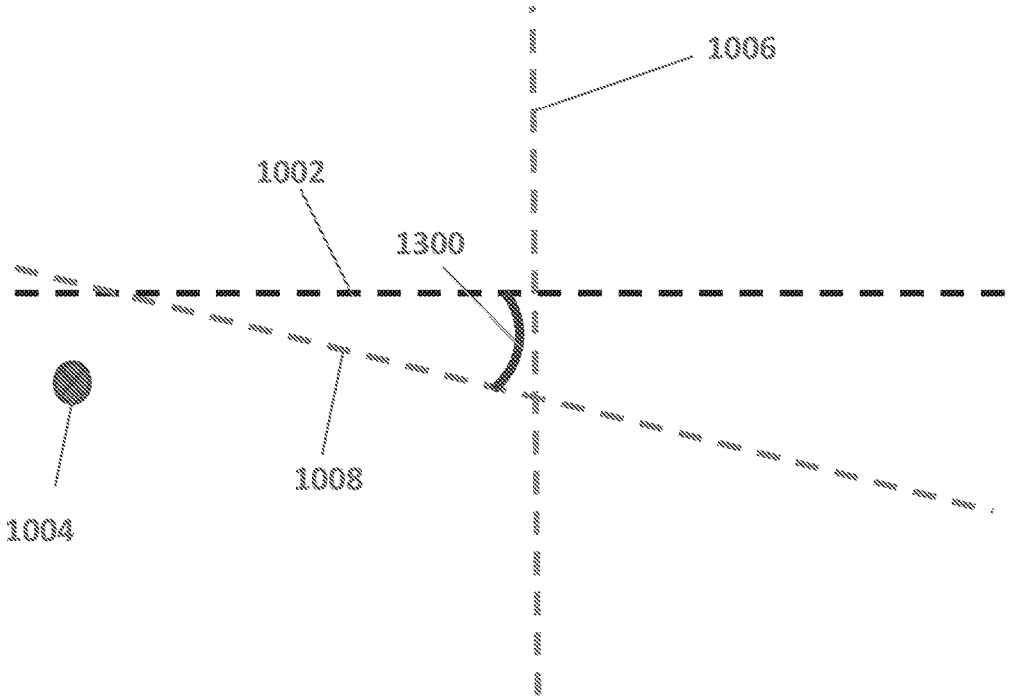
FIG. 13 is a top view of the axes shown in FIG. 10.

With reference now to FIGS. 2 and 10-12, according to some aspects of the present teaching, one or more power cable pulley/wheels 1000, two shown, may be provided. One pulley/wheel 1000 may be provided on each side of the riser 112, as shown. Each pulley/wheel 1000 may rotate in clockwise or counterclockwise directions 1202, as indicated in FIG. 12, around a pivot pin or axle, such as a shoulder screw, based on the forces placed on the pulley/wheel 1000 by the power cable 210 as the crossbow is operated. The rotation of the pulley/wheel 1000 during operation may be over 360 degrees, depending on the specific design used. Each power cable pulley/wheel 1000 may receive a separate power cable 210 (shown in FIGS. 2 and 12). Each power cable 210 may be received around the pulley/wheel 1000, as shown, and may have opposite ends 1204, 1206 that attach to a cam or the like in any manner chosen with the sound judgment of a person of skill in the art. According to some aspects of the present teaching, end 1204 may attach to a top portion of a cam/wheel, such as with a known lobe hook up, and end 1206 may attach to a bottom portion of a cam/wheel, such as with a known lobe hook up. Each pulley/wheel 1000 may receive only a power cable. According to some aspects of the present teaching, neither power cable 210, 210 crosses the main beam 102, as shown.

With continuing reference to FIGS. 2 and 10-12, according to some aspects of the present teaching, each power cable pulley/wheel 1000 may be inset mounted to the riser 112. By inset mounted it is meant that at least a portion of the power cable pulley/wheel 1000 is positioned within the riser 112. According to some aspects of the present teaching, the power cable pulley/wheel 1000 may be fully inset mounted. By fully inset mounted it is meant that all of the power cable pulley/wheel 1000 is positioned within the riser 112. FIGS. 1, 2, 4, 8 and 10-11 show fully inset cable pulley/wheels. A power cable pulley/wheel 1000 may have a thickness 1100, shown in FIG. 11, and an outside diameter 1200, shown in FIG. 12. A power cable pulley/wheel 1000 may be received, as shown in FIG. 11, within a slot 1102 formed in the riser 112, making it inset mounted. The slot 1102 may have a width 1104, a height 1106 and a depth 1108, as shown in FIG. 11. For the power cable pulley/wheel 1000 to be fully inset with the orientation shown, slot width 1104 may be equal to or greater than pulley/wheel thickness 1100 and both slot height 1106 and slot depth 1108 may be equal to or greater than pulley/wheel OD 1200.

With reference now to FIGS. 2 and 10-13, according to some aspects of the present teaching, bowstring 204 may have a longitudinal axis 1002 across the main beam 102 when in its uncocked condition, cam 208 may have a rotational axis 1004 about which it may rotate, main beam 102 may have a longitudinal axis 1006, and power cable pulley 1000 may have a rotational axis 1008 about which it may rotate. When the riser 112 is properly attached to the main beam 102: (1) the main beam longitudinal axis 1006 may be parallel to the longitudinal axis of riser opening 400; (2) the main beam longitudinal axis 1006 may be perpendicular to the bowstring longitudinal axis 1002; (3) the rotational axis 1004 of cam 208 may be perpendicular to the main beam longitudinal axis 1006, the bowstring longitudinal axis 1002, and the rotational axis 1008 of power cable pulley 1000; and, (4) the rotational axis 1008 of power cable pulley 1000 may form an acute angle 1300 with the bowstring longitudinal axis 1002. According to some aspects of the present teaching, acute angle 1300 may range between 5 degrees and 85 degrees. According to other aspects of the present teaching, acute angle 130 may range between 10 degrees and 80 degrees; 15 degrees and 75 degrees; or, 20 degrees and 70 degrees. For the specific non-limiting aspect of the present teaching shown, acute angle 1300 is about 70 degrees.

Figure 14:
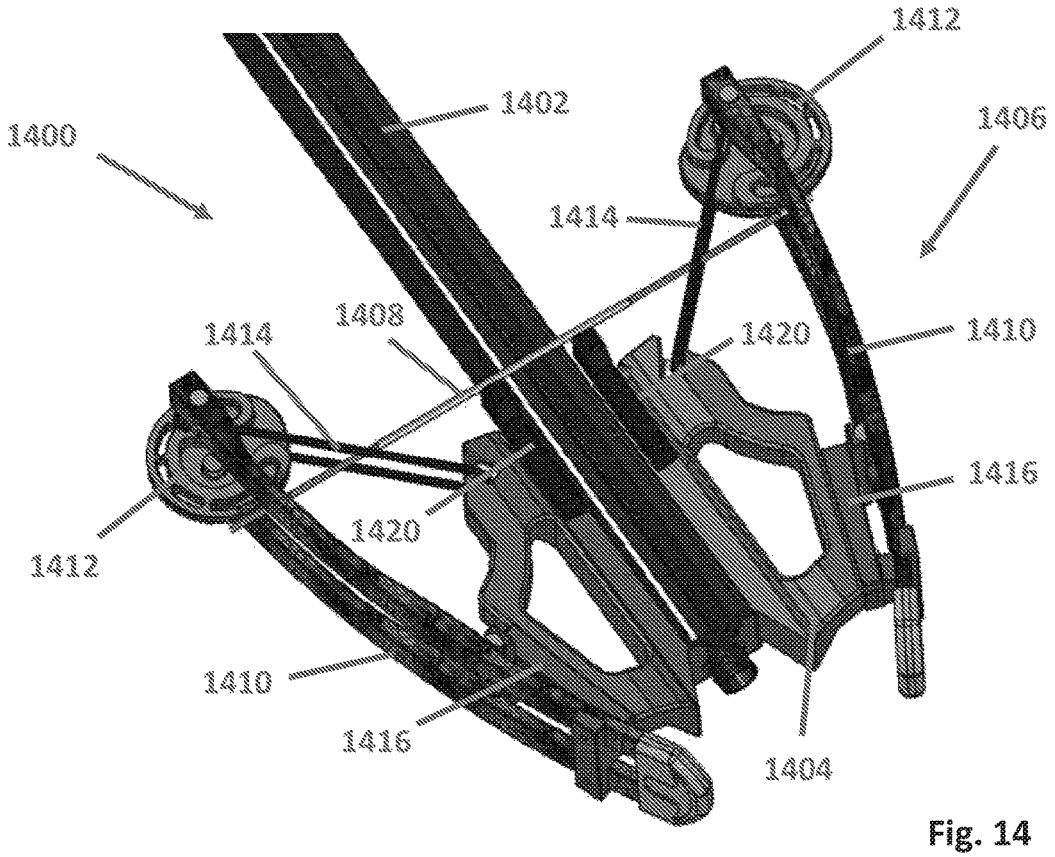
FIG. 14 is a top perspective view of the distal end of a crossbow.

With reference now to FIG. 14, a crossbow 1400 according to some aspects of the present teaching is shown. Crossbow 1400 may include a main beam 1402, a riser or block 1404 and a bow assembly 1406. Crossbow 1400 may include other crossbow components that are not shown, such as a trigger mechanism. Main beam 1402 may interconnect to riser 1404 in a manner similar to the interconnection between main beam 102 and riser 112 discussed above. The bow assembly 1406 may be adapted to propel an arrow and may comprise a bowstring 1408 and a bow having a pair of bow limbs 1410, 1410 that receive the bowstring 1408. The bow limbs 1410, 1410 may be attached to the riser 1404 using attachment brackets 1416, 1416 similar to the attachment brackets 700, 700 discussed above. A pair of cams (which may be also pulleys and/or wheels) 1412, 1412 may be mounted to the bow limbs 1410, 1410 and receive the bowstring 1408 in a known manner.

Figure 15:
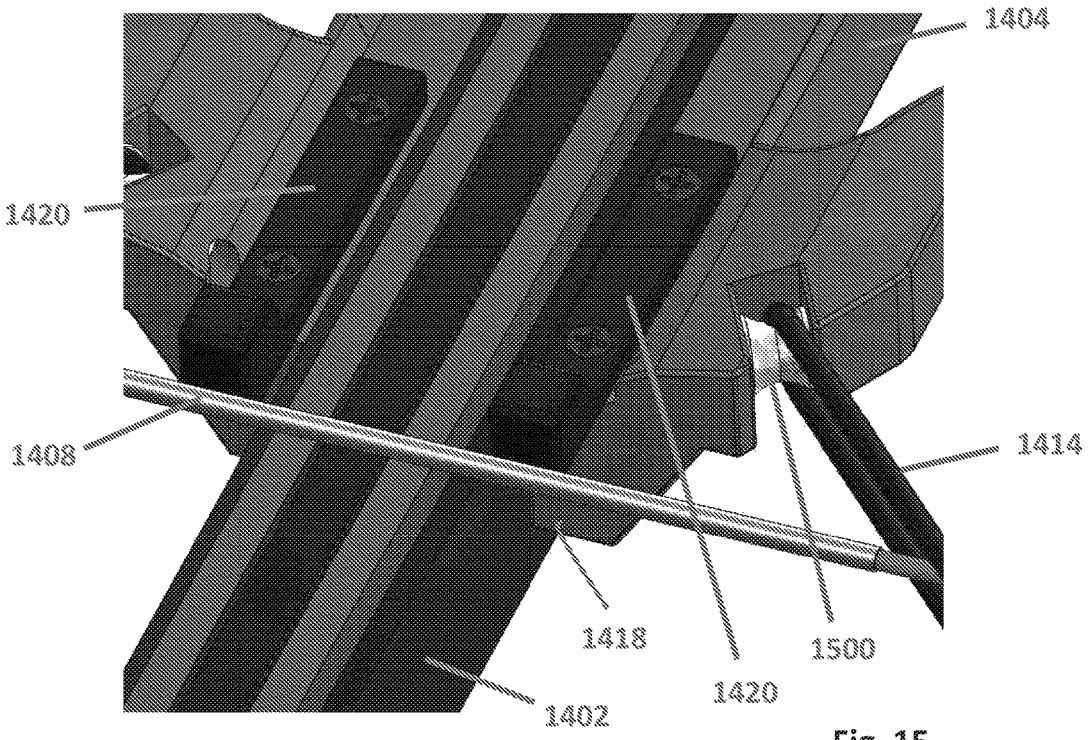
FIG. 15 is a close-up top perspective view of a portion of the crossbow shown in FIG. 14.
Figure 16:
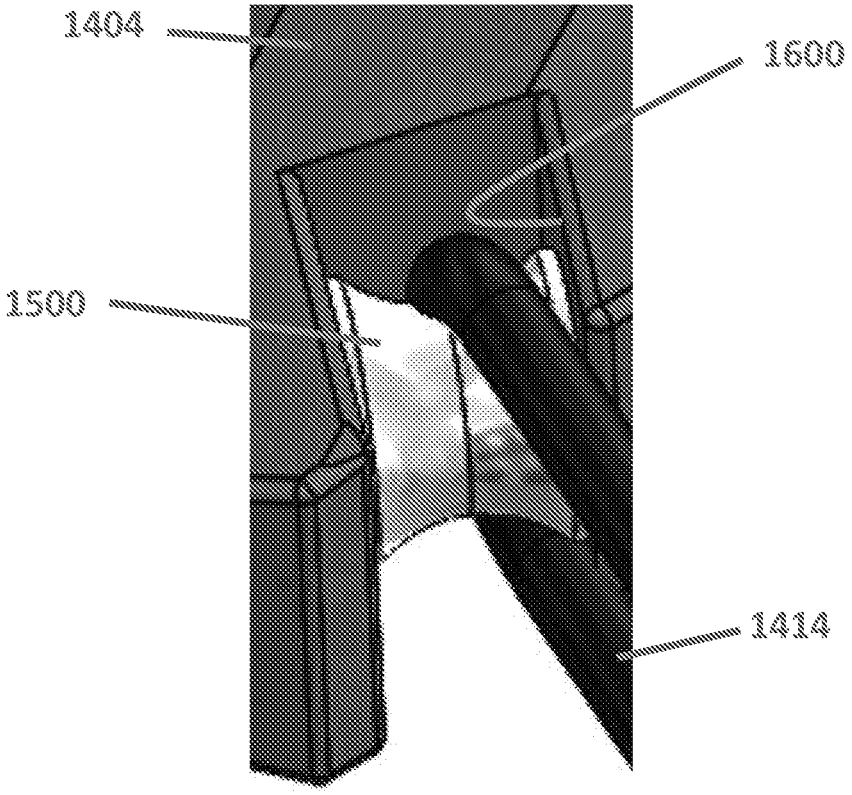
FIG. 16 is a close-up perspective view of a power cable pulley/wheel shown in FIG. 15.

With reference now to FIGS. 14-16, a power cable 1414 may be interconnected between each cam 1412 and the riser 1404. According to some aspects of the present teaching, each power cable 1414 may be received on a power cable pulley/wheel 1500 that is rotatable with respect to the riser 1404. Each power cable pulley/wheel 1500 may operate and may be oriented similar to power cable pulley/wheel 1000 described above. Each power cable pulley/wheel 1500 may be inset mounted to the riser 1404. The power cable pulley/wheels 1500 may be fully inset mounted within riser slot 1600, as shown. The power cable pulley/wheels 1500 may have a smaller OD at their axial center than at their axial outer ends, as shown and as with power cable pulley/wheels 1000 described above. Power cable pulley/wheels 1500 may have a larger thickness to maximum OD ratio than pulley/wheels 1000, as shown.

Figure 17:
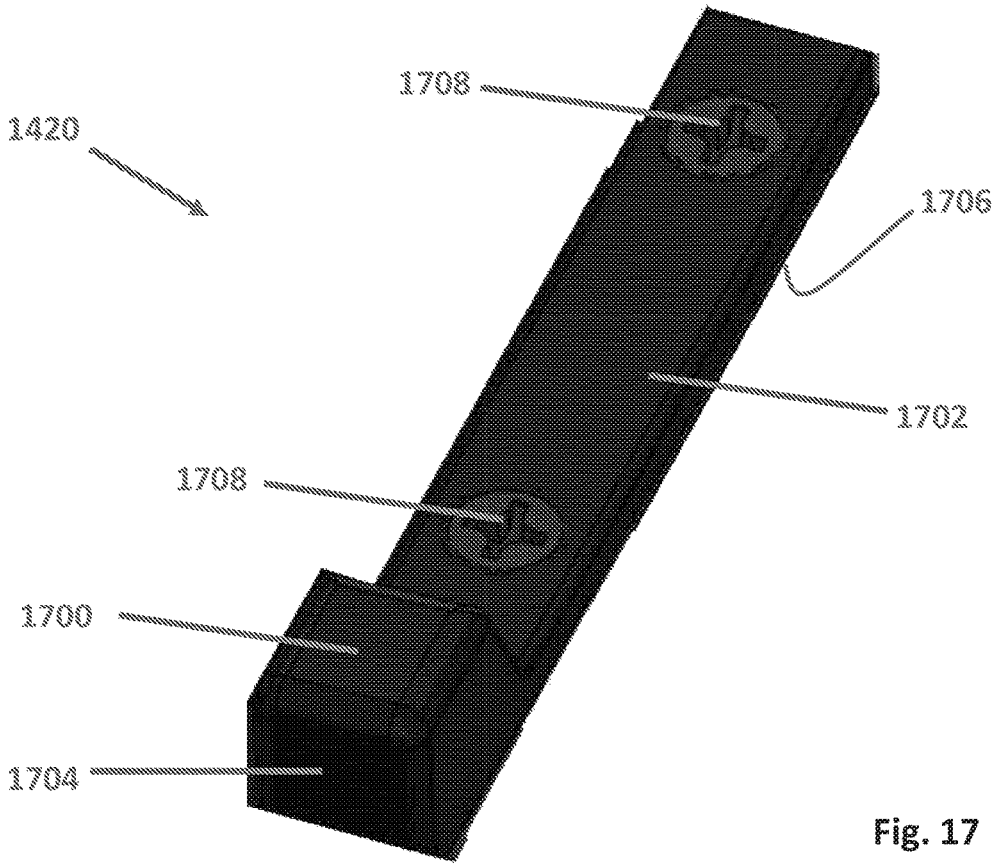
FIG. 17 is a close-up perspective view of a bowstring dampener shown in FIG. 15.

With reference now to FIGS. 14-15 and 17, according to some aspects of the present teaching, one or more bowstring dampeners, two shown 1420, 1420, may be used to dampen vibrations created by firing the crossbow 1400. Each dampener 1420 may have a bowstring contact portion 1700 and a riser attachment portion 1702. The bowstring contact portion 1700 may be generally cube shaped, but without sharp corners, as shown. Though the dimensions can be any chosen with the sound judgment of a person of skill in the art, according to some aspects of the present teaching, shown, the height, width and depth are all on the order of 0.5 inches. The bowstring contact portion 1700 may be formed of a vibration dampening material and may have a contact surface 1704 designed to be contacted by the bowstring 1408, as shown in FIGS. 14 and 15. The riser attachment portion 1702 may be generally rectangular, as shown, with a bottom surface 1706 that contacts and is supported on a surface of the riser 1404, as shown. One or more connectors, two screws 1708, 1708 shown, may be used to attach each bowstring dampener 1420 to the riser 1404. Each bowstring dampener 1420 may be formed as a single component in a molding operation. Each bowstring dampener 1420 may be positioned so that the bowstring contact portion 1700 extends proximally beyond the proximal end 1418 of the riser 1404, as shown.

Numerous embodiments have been described herein. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof. Further, the "invention" as that term is used in this document is what is claimed in the claims of this document. The right to claim elements and/or sub-combinations that are disclosed herein as other inventions in other patent documents is hereby unconditionally reserved

Having thus described the present subject matter, it is now claimed:

1. A bow assembly comprising
a main beam elongated in a first direction to define
a distal end, and
a proximal end opposite the distal end,
wherein the distal end has a distal end facing surface from which extend,
an upper member elongated in the first direction, and
a lower member separate from the upper member, the lower member,
being elongated in the first direction, and
having a first set of threads thereon; and
a riser having
a proximate facing surface,
an upper groove dimensioned to engage the upper member in a close sliding fit, and
a lower opening through hole dimensioned to engage the lower member in a close sliding fit;
a threaded fastener having a second set of threads adapted to threadedly engaged the first set of threads;
wherein the riser is assembled with the main beam and the threaded fastener such that
the upper member is inserted within the upper groove,
the lower member is inserted within the lower opening,
the distal end facing surface faces the proximate facing surface,
the threaded fastener is threadedly engaged with the first set of threads;
further having,
a first attachment bracket engaged to the riser,
a second attachment bracket engaged to the riser, a first bow limb operationally engaged with the first attachment bracket, a second bow limb operationally engaged with the second attachment bracket, a first cam mounted to the first bow limb to be pivotable about a first cam axis, a second cam mounted to the second bow limb to be pivotable about a second cam axis, a first power cable pulley inset into riser to be pivotable about a first power cable pulley axis, a second power cable pulley inset into the riser to be pivotable about a second power cable pulley axis, a first power cable interconnected between the first cam and the first power cable pulley, and a second power cable interconnected between the first cam and the first power cable pulley;

wherein neither power cable crosses the main beam;

wherein the first cam axis is not parallel to the first power cable pulley axis; and wherein the second cam axis is not parallel to the second power cable pulley axis.

* * * * *